US010111459B2

(12) United States Patent
Gianese et al.

(10) Patent No.: US 10,111,459 B2
(45) Date of Patent: Oct. 30, 2018

(54) ASSEMBLY MACHINE FOR PRODUCING CIGARETTES, AND RELATIVE ASSEMBLY METHOD

(71) Applicant: G.D SOCIETA' PER AZIONI, Bologna (IT)

(72) Inventors: Giampaolo Gianese, Sasso Marconi (IT); Marco Esposti, Casalecchio di Reno (IT); Ivan Eusepi, Castelmaggiore (IT); Massimo Sartoni, Bologna (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 595 days.

(21) Appl. No.: 14/438,236

(22) PCT Filed: Oct. 25, 2013

(86) PCT No.: PCT/IB2013/059669
§ 371 (c)(1),
(2) Date: Apr. 24, 2015

(87) PCT Pub. No.: WO2014/064655
PCT Pub. Date: May 1, 2014

(65) Prior Publication Data

US 2015/0289559 A1 Oct. 15, 2015

(30) Foreign Application Priority Data

Oct. 25, 2012 (IT) ..... BO2012A0582

(51) Int. Cl.
*A24C 5/47* (2006.01)
*A24D 3/02* (2006.01)

(52) U.S. Cl.
CPC ..... *A24C 5/475* (2013.01); *A24D 3/0287* (2013.01)

(58) Field of Classification Search
None
See application file for complete search history.

(56) References Cited

U.S. PATENT DOCUMENTS

2006/0157070 A1 7/2006 Belcastro et al.
2006/0201523 A1 9/2006 Schlisio et al.

FOREIGN PATENT DOCUMENTS

WO WO-2006/070289 A1 7/2006
WO WO-2012/164067 A2 12/2012

OTHER PUBLICATIONS

International Search Report for International Search Report No. PCT/IB2013/059669, dated Apr. 22, 2014.

*Primary Examiner* — Michael H. Wilson
*Assistant Examiner* — Katherine A Will
(74) *Attorney, Agent, or Firm* — Marshall, Gerstein & Borun LLP

(57) ABSTRACT

A method and assembly machine for producing multicomponent cigarettes, each having a number of portions. The assembly machine has a combining unit for forming groups of portions, each having at least two different first portions which are fed perpendicularly to their central axis; a first wrapping unit, which receives a succession of groups of portions from the combining unit, feeds them perpendicularly to their central axis, and winds a first sheet of wrapping material around each group of portions; and a second wrapping unit, which receives a succession of groups of portions from the first wrapping unit, feeds them perpendicularly to their central axis, and winds a second sheet of wrapping material around each group of portions.

17 Claims, 5 Drawing Sheets

ASSEMBLY MACHINE FOR PRODUCING CIGARETTES, AND RELATIVE ASSEMBLY METHOD

CROSS-REFERENCE TO RELATED APPLICATIONS

This is the U.S. national phase of PCT/IB2013/059669, filed Oct. 25, 2013, which claims the benefit of Italian Patent Application No. BO2012A000582, filed Oct. 25, 2012.

TECHNICAL FIELD

The present invention relates to an assembly machine for producing cigarettes, and to a relative assembly method.

BACKGROUND ART

Demand within the industry has recently extended to the manufacture of multicomponent cigarettes, each of which comprises a number of end-to-end portions, at least one of which is normally defined by a filter element, and at least another of which is defined by an aromatic, preferably tobacco-based, element.

Manufacturing cigarettes of this type calls for an assembly machine adaptable to different portion combinations.

Patent Application US-A1-2006201523, for example, describes a filter-tipped cigarette manufacturing machine, in which the cigarette comprises a tobacco portion, and a combination filter in turn comprising at least three different component parts. The cigarette manufacturing machine comprises a combining unit for forming groups of filter portions, each group comprising three different filter portions aligned axially and contacting end to end; and a unit for forming a continuous tobacco rod, which is cut into double-length portions and fed to a wrapping unit. The wrapping unit receives a succession of groups of double-length filter portions from the combining unit and a succession of double-length tobacco portions, and is designed to form groups, each comprising a tobacco portion, a double-length filter portion, and a tobacco portion, and to wrap them in a sheet of wrapping material to form double-length cigarettes, which are then cut into individual cigarettes. The manufacturing machine is T- or L-shaped, in which the unit for forming the tobacco portions is perpendicular to the assembly comprising the combining unit and the wrapping unit.

The manufacturing machine described in US-A1-2006201523 has several drawbacks, by being bulky and not allowing for fast, easy brand change (i.e. switching from production of one type of cigarette to another). To meet changing market demand, on the other hand, a modern manufacturing machine of this type must be capable of producing different types of cigarettes effectively and efficiently.

Documents US-A1-2006157070 and WO-A1-2006070289 describe cigarette manufacturing assembly machines comprising a combining unit for forming groups of filter elements, each comprising at least two different first filter elements aligned axially, and in which the groups of filter elements are fed perpendicularly to their central axis. The combining unit comprises a number of structurally similar, though not identical, feed stations, each of which supplies a respective filter element to form the groups of filter elements; and each feed station comprises an insertion drum, which receives the groups of filter elements from a preceding feed station or creates the groups of filter elements, receives respective filter elements, and inserts the respective filter elements into the groups of filter elements.

The assembly machine also comprises a first wrapping unit, which receives a succession of groups of filter elements from the combining unit, feeds the groups of filter elements perpendicularly to their central axis, and winds a first sheet of wrapping material partly about each group of filter elements. The first wrapping unit feeds the groups of filter elements aligned axially but not contacting end to end, to allow a follow-up station to insert granules and/or similar particles into the gaps between adjacent filter elements.

The assembly machine also comprises a further wrapping unit, which receives a succession of groups of filter elements from the first wrapping unit, feeds the groups of filter elements perpendicularly to their central axis, and winds a second sheet of wrapping material partly about each group of filter elements, so it overlaps the first sheet of wrapping material, to complete the filter, to which a tobacco portion is then connected.

DESCRIPTION OF THE INVENTION

It is an object of the present invention to provide a cigarette manufacturing assembly machine designed to eliminate the aforementioned drawbacks, and which is cheap and easy to implement.

It is a further object of the present invention to provide a cigarette assembly method designed to eliminate the aforementioned drawbacks, and which is cheap and easy to implement.

According to the present invention, there are provided an assembly machine for producing cigarettes, and a relative assembly method, as claimed in the accompanying Claims.

BRIEF DESCRIPTION OF THE DRAWINGS

A non-limiting embodiment of the present invention will be described by way of example with reference to the attached drawings, in which.

PREFERRED EMBODIMENTS OF THE INVENTION

Figure 1:
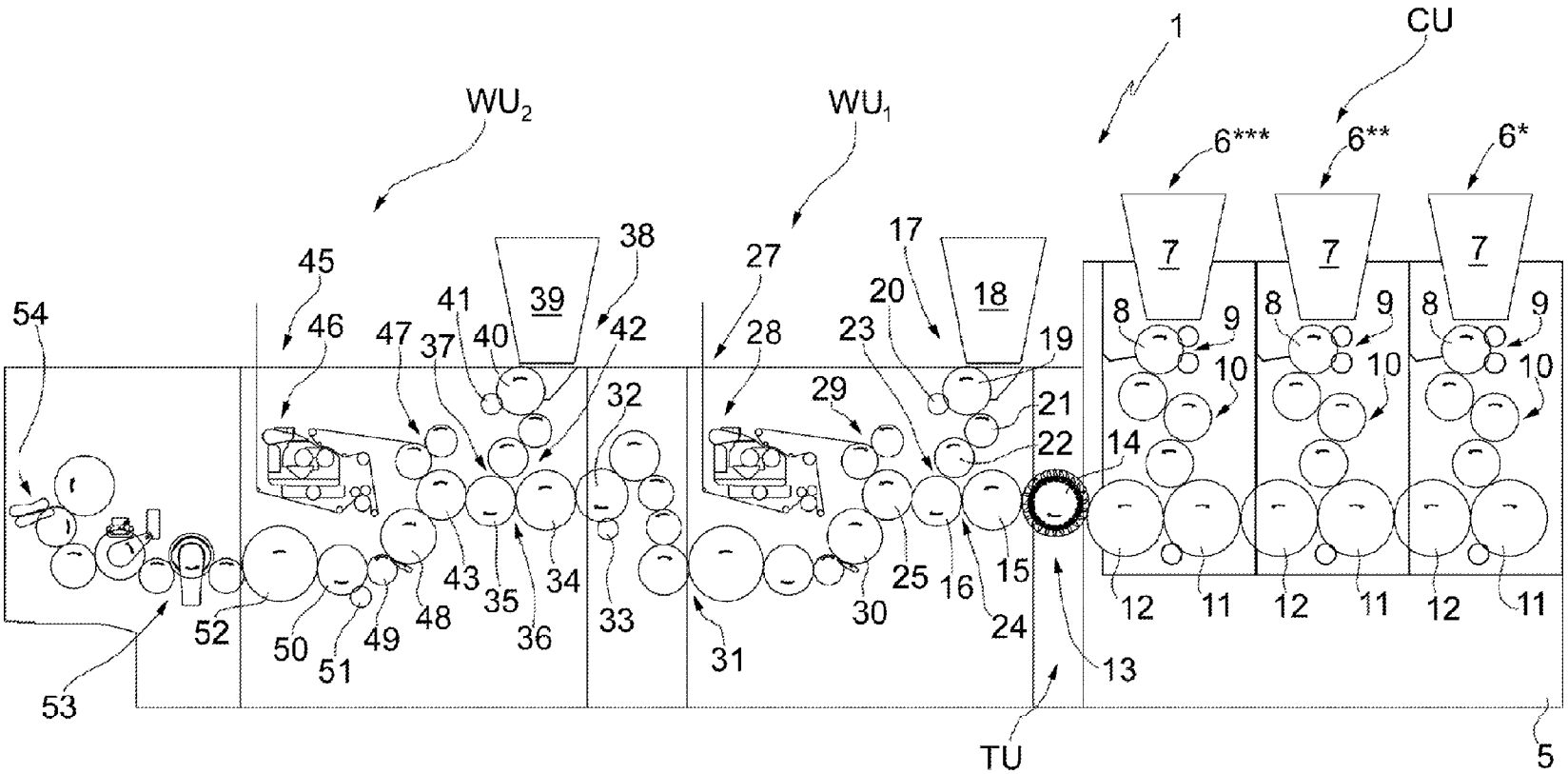
FIG. 1 shows a schematic front view, with parts removed for clarity, of a cigarette manufacturing assembly machine in accordance with the present invention.
Figure 2:
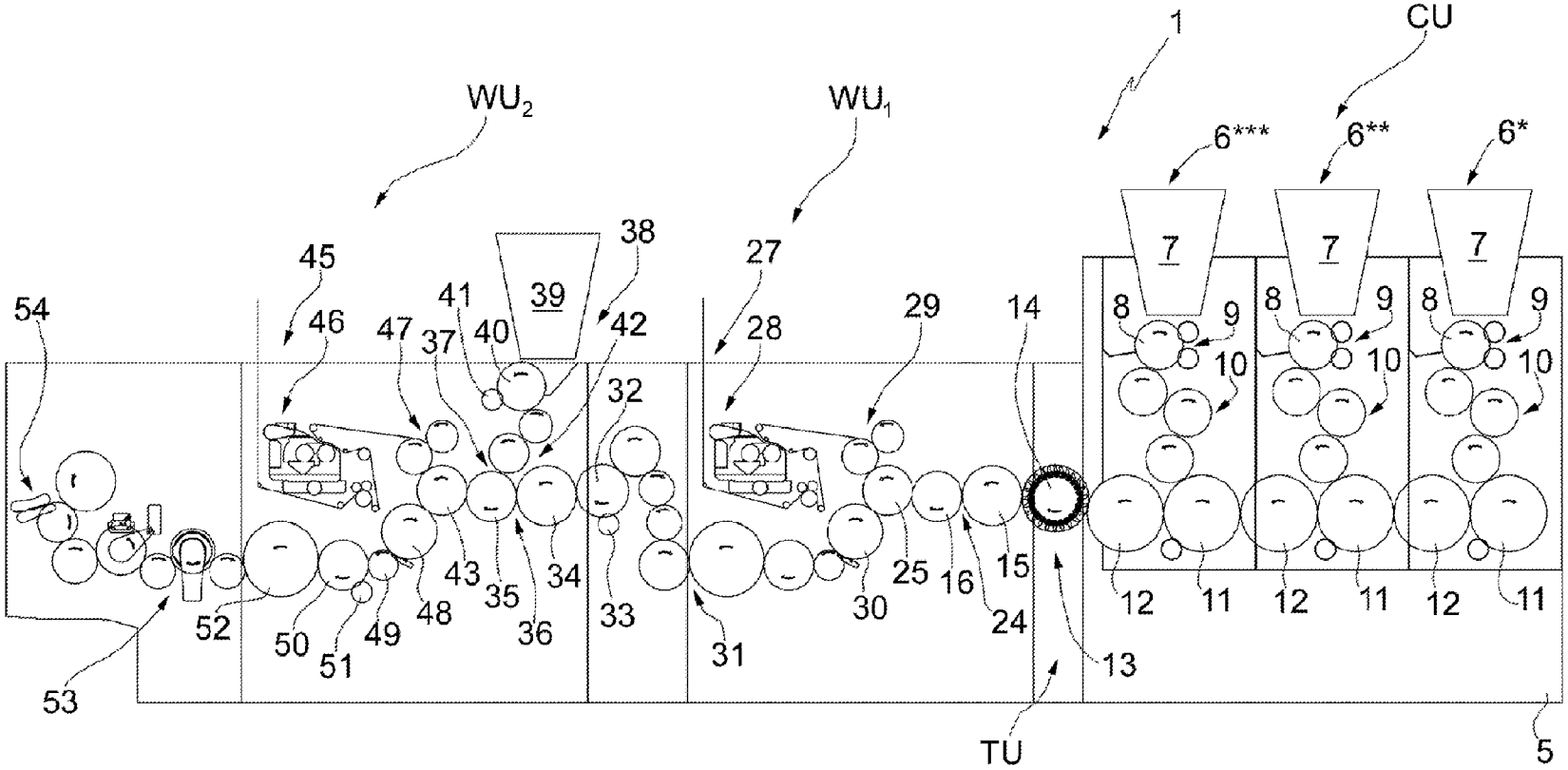
FIG. 2 shows a schematic front view, with parts removed for clarity, of a variation of the FIG. 1 assembly machine.
Figure 3:
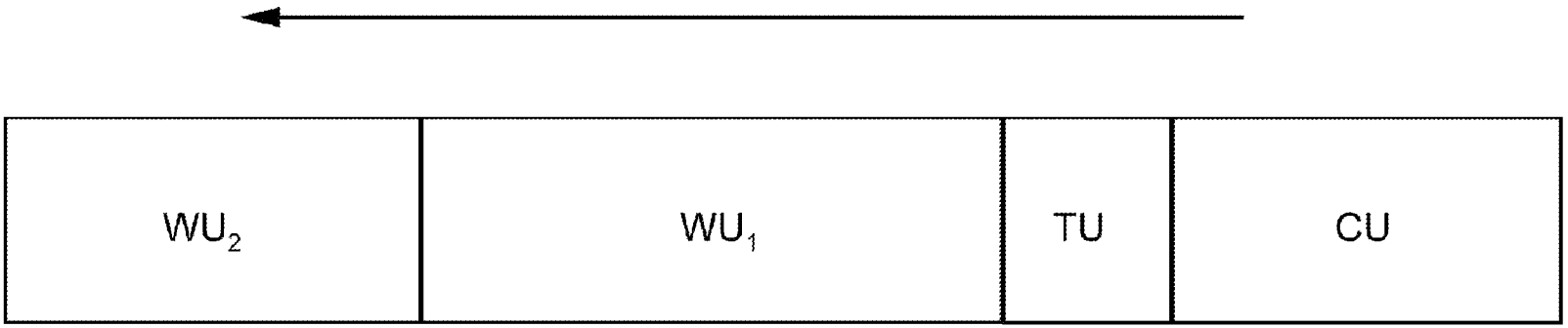
FIG. 3 shows a schematic plan view of the FIG. 1 assembly machine.

In FIGS. 1 to 3, number 1 indicates as a whole an assembly machine for producing multicomponent cigarettes 2. Each cigarette 2 comprises a number of portions 3 with a central axis X, and of which at least one portion 3 is defined by a filter element, and at least one portion 3 is defined an aromatic, preferably tobacco-based, element.

As shown schematically in FIG. 3, assembly machine 1 has a straight-line layout, and comprises a combining unit CU for forming portion groups 4; a transfer unit TU; a wrapping unit $WU_1$; and a wrapping unit $WU_2$.

Combining unit CU forms portion groups 4, each preferably comprising a number of axially aligned portions 3, and which are fed transversely (i.e. perpendicularly to their central axis X). Transfer unit TU is located downstream from combining unit CU, transfer portion groups transversely (i.e. perpendicularly to central axis X) from combining unit CU to wrapping unit $WU_1$.

As described in more detail below, wrapping unit $WU_1$ receives a succession of portion groups 4 from transfer unit TU, inserts further portions 3 into portion groups 4, winds a sheet of wrapping material about the succession of portion groups 4 and, finally, cuts portion groups 4 apart transversely.

Finally, wrapping unit $WU_2$ receives portion groups from wrapping unit $WU_1$, inserts further portions 3 into portion groups 4, winds a further sheet of wrapping material about the succession of portion groups 4 and, finally, cuts portion groups 4 transversely into two cigarettes 2, which are carried off assembly machine 1 by an output conveyor.

More specifically, and as shown more clearly in FIGS. 1 and 2, combining unit CU comprises a frame 5, which rests on the floor and supports a number of structurally identical feed stations 6, each for supplying respective portions 3 from which to form portion groups 4.

More specifically, combining unit CU comprises three feed stations 6*, 6 and 6*** . Each feed station comprises a top hopper 7 containing a mass of respective portions 3; and a pickup drum 8, which withdraws portions 3 successively from the bottom of top hopper 7, and cooperates with a cutting device 9 with blades for cutting portions 3 transversely into portions 3 of desired length. Each feed station 6 also comprises a number of—in particular, three—aligning and transfer drums 10, which receive, align and, if necessary, axially part portions 3 of desired length from pickup drum 8. Each feed station 6 also comprises an insertion drum 11, which receives portion groups 4 from a preceding feed station 6 or, in the case of the first feed station 6*, creates portion groups 4. On insertion drum 11, the portions 3 of desired length from aligning drum 10 are inserted into respective portion groups 4. Finally, each feed station 6 comprises an output drum 12, which receives portion groups 4 from insertion drum 11, and transfers them to the next feed station 6 or, in the case of the last feed station 6***** , to transfer unit TU.

In a first embodiment shown schematically in FIGS. 4*a* to 4*c*, feed station 6* forms a portion group 4* of two coaxial portions 3A contacting end to end (FIG. 4*a*).

Figure 4:
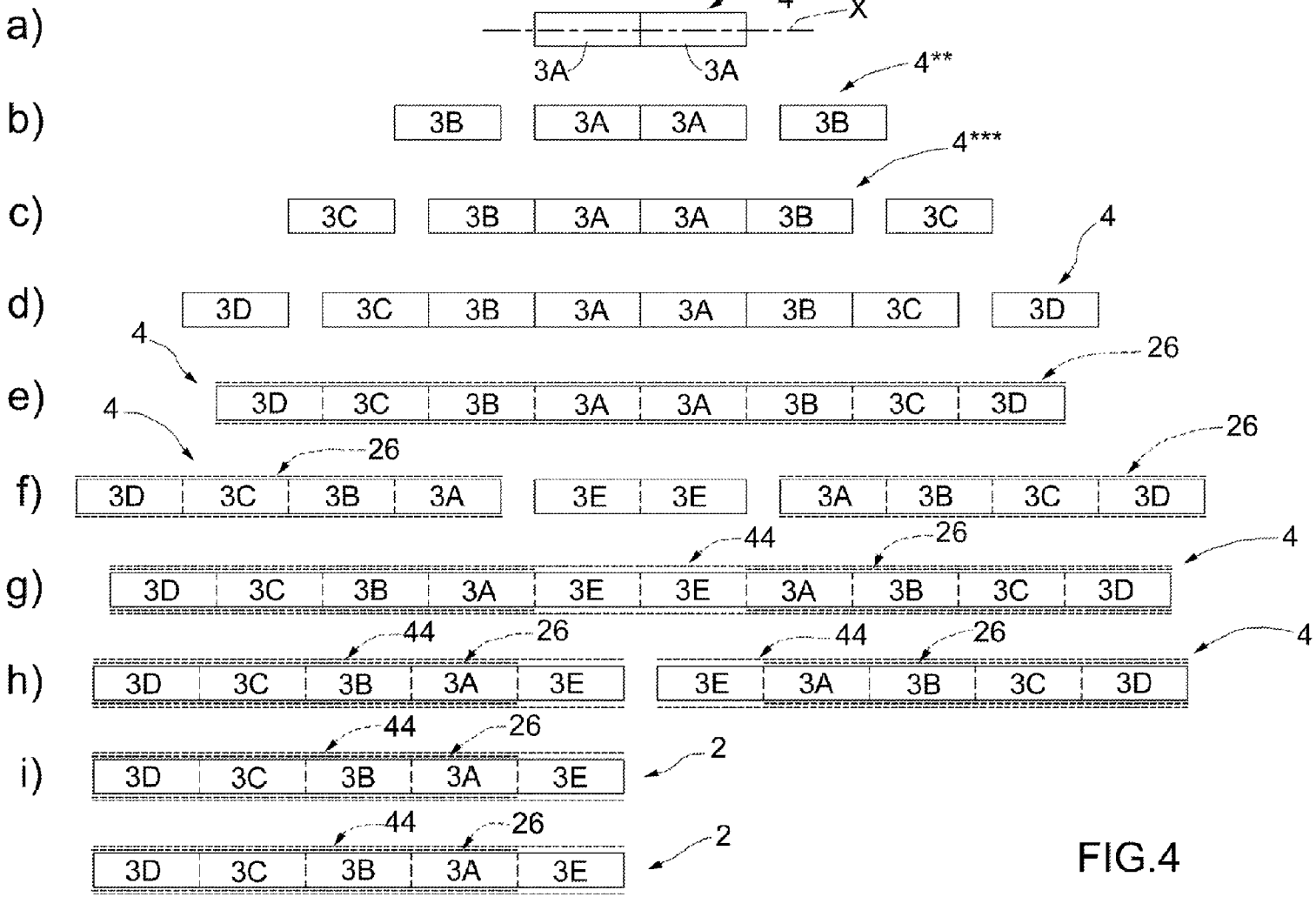
FIGS. 4*a* to 4*i* show schematics of the steps in the method of assembling two cigarettes, in accordance with a first embodiment of the present invention.

Feed station 6 forms a portion group 4**, in which two portions 3B are positioned coaxial with portion group 4* from feed station 6*, each with one end facing and contacting a respective end of portion group 4*. In other words, portion group 4* is interposed between two portions 3B at feed station 6** (as shown in FIG. 4***b*).

Finally, feed station 6* forms a portion group 4*** , in which two portions 3C are positioned coaxial with portion group 4** from feed station 6**, each with one end facing and contacting a respective end of portion group 4**. In other words, portion group 4** is interposed between two portions 3C at feed station 6*** (as shown in FIG. 4***c*).

In another preferred embodiment shown schematically in FIGS. 5*a* to 5*c*, feed station 6* forms a portion group 4*, in which two portions 3A are first positioned coaxial and contacting end to end, and are then spaced axially a given distance apart.

Figure 5:
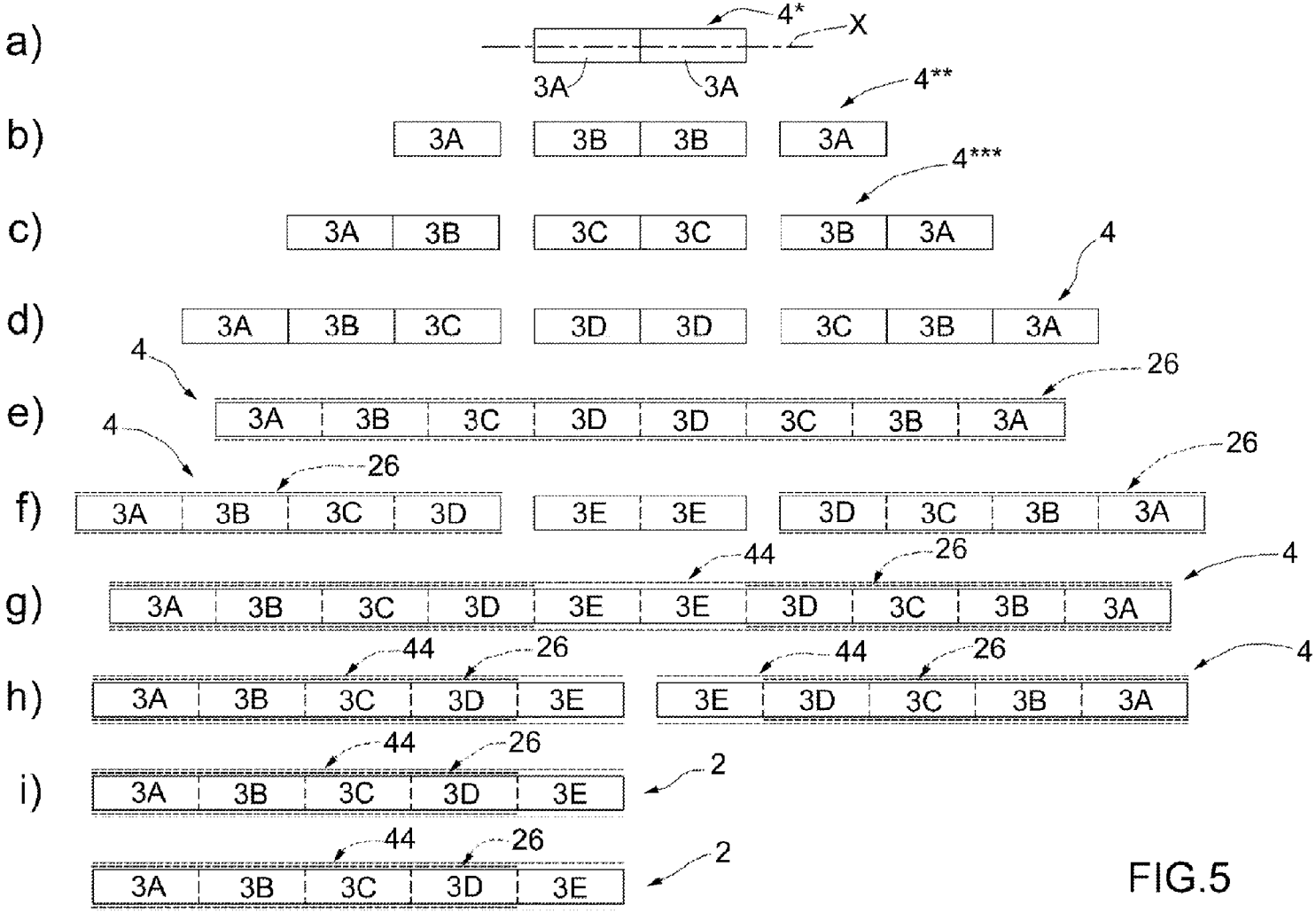
FIGS. 5*a* to 5*i* show schematics of the steps in the method of assembling two cigarettes, in accordance with a second embodiment of the present invention.

Feed station 6 forms a portion group 4**, in which two portions 3B are interposed coaxially between the two portions 3A from feed station 6*, each with one end facing a respective portion 3A. Portions 3A, initially contacting end to end, are spaced axially a given distance apart to insert the two portions 3B. In other words, portion group 4* from feed station 6* is divided centrally to accommodate the two portions 3B at feed station 6** (as shown in FIG. 5***b*).

Finally, feed station 6* forms a portion group. 4*** , in which two portions 3C are interposed coaxially between the two portions 3B inserted at feed station 6**, each with one end facing a respective portion 3B. Portions 3B, initially contacting end to end, are spaced axially a given distance apart to insert the two portions 3C. In other words, portion group 4** from feed station 6** is divided centrally to accommodate the two portions 3C at feed station 6*** (as shown in FIG. 5***c*).

In the above description, combining unit CU comprises three feed stations 6, but may obviously comprise any number of feed stations 6 for supplying portions 3.

It is important to note that combining unit CU transfers portion groups 4 to the downstream transfer unit TU with portions 3 aligned axially and contacting end to end, i.e. with no gaps between portions 3 in each portion group 4.

Transfer unit TU is also fitted to frame 5, and comprises a device 13 defined by a drum 14, which rotates continuously about an axis of rotation and supports a number of peripheral members, each with a suction pickup head. The peripheral members are designed to receive respective portion groups 4 from output drum 12 of the last feed station 6*** of combining unit CU, and to feed them to wrapping unit $WU_1$.

Wrapping unit $WU_1$ is also fitted to frame 5, and is designed to receive portion groups 4 from transfer unit TU, and to feed them forward transversely. More specifically, transfer unit TU transfers portion groups successively to a pickup drum 15 fitted with peripheral suction seats for portion groups 4.

From pickup drum 15, portion groups 4 are transferred to a follow-up combining drum 16, also fitted with peripheral suction seats for portion groups 4. In the FIG. 1 embodiment, wrapping unit $WU_1$ comprises a feed unit 17 for supplying portions 3D. More specifically, a hopper 18 houses a mass of portions 3D, and has a bottom outlet connected to a pickup drum 19 with peripheral suction seats for portions 3D. Pickup drum 19 cooperates with a blade 20 for cutting portions 3D transversely into portions 3D of desired length.

Portions 3D of desired length are transferred from pickup drum 19 to a transfer drum 21 with peripheral suction seats for portions 3D. From transfer drum 21, portions 3D are transferred to a parting drum 22 designed to part portions 3D axially (by simultaneously moving both portions 3D axially). In other words, portions 3D are positioned axially end to end when loaded onto parting drum 22, and are spaced axially apart when unloaded off parting drum 22.

At an input station 23, the axially parted portions 3D are transferred from parting drum 22 to combining drum 16 which, at a further input station 24 upstream from input station 23, receives portion groups 4 supplied by pickup drum 15 from transfer unit TU.

In the variation shown schematically in FIG. 4*d*, combining drum 16 forms a portion group 4, in which the two portions 3D are coaxial with the portion group 4* from the last feed station 6*** , and are each positioned with one end facing and contacting a respective end of portion group 4*** . In other words, the portion group 4*** from the last feed station 6*** is interposed between two portions 3**D.

In the variation shown schematically in FIG. 5*d*, a transfer drum 22 is substituted for parting drum 22, and from which portions 3D are unloaded axially contacting end to end.

Combining drum 16 forms a portion group 4, in which the two portions 3D are coaxial with the portion group 4* from the last feed station 6*, are interposed coaxially between the two portions 3C inserted at the last feed station 6*, and are each positioned with one end facing a respective portion 3C. Portions 3C, initially contacting end to end, are spaced axially apart to insert the two portions 3D. In other words, the portion group 4* from the last feed station 6* is divided centrally to accommodate the two portions 3D.

Portion groups 4 are transferred from combining drum 16 to an application drum 25 with peripheral seats for portion groups 4. At a feed station, a sheet 26 of wrapping material, supplied by a feed unit 27, is applied to each, portion group 4 in a seat on application drum 25.

Each sheet 26 of wrapping material serves to mechanically connect portions 3A, 3B, 3C and 3D in portion group 4 (as shown in FIGS. 4*e* and 5*e*).

As shown in FIGS. 1 and 2, feed unit 27 comprises an unwinding station 28 where a single-width strip is unwound off a reel (not shown); and a set of guide rollers for feeding the strip to a transverse cutting station 29, which comprises a roller that cooperates with a counter-roller, equipped with a number of peripheral blades, to cut the continuous strip transversely into individual sheets 26 of wrapping material, which are then fed to application drum 25 and wound about portion groups 4 on application drum 25.

Wrapping unit $WU_1$ winds one sheet 26 of wrapping material about the whole circumference of each portion group 4. Sheet 26 of wrapping material surrounds the whole of each portion group 4, so as to mechanically connect portions 3 in each portion group 4.

Portion groups 4 with sheets 26 of wrapping material are transferred from application drum 25 to a rolling drum 30, on which winding of sheet 26 of wrapping material about each portion group 4 is completed to form a tubular wrapping coaxial with central axis X.

Wrapping unit $WU_1$ comprises a known intermediate part 31 (not described in detail) comprising a number of drums, on which portion groups 4 are fed transversely from rolling drum 30 to a cutting drum 32, which cooperates with a blade 33 to transversely cut each portion group 4 centrally, at portions 3A, into two specular portion groups 4 coaxial with central axis X and contacting end to end.

Wrapping unit $WU_2$ is also fitted to frame 5, receives portion groups 4 from wrapping unit $WU_1$, and feeds them forward transversely. More specifically, wrapping unit $WU_2$ transfers portion groups 4 successively from cutting drum 32 of wrapping unit $WU_1$ to a parting drum 34. On parting drum 34, each two portion groups 4, initially contacting end to end, are parted axially (by axially moving at least one portion group 4) so they are positioned coaxial and a given axial distance apart. In other words, portion groups 4 are positioned axially end to end when loaded onto parting drum 34, and are spaced axially apart when unloaded off parting drum 34.

Parting drum 34 picks up portion groups 4 from an input station at cutting drum 32, and feeds them, spaced apart, to an output station at a follow-up combining drum 35.

The axially parted portion groups 4 are transferred to combining drum 35 at an input station 36. At a further input station 37 downstream from input station 36, each portion group 4 is positioned to receive another portion 3E of desired length.

Wrapping unit $WU_2$ comprises a feed unit 38 for supplying portions 3E. More specifically, a hopper 39 houses a mass of portions 3E, and has a bottom outlet connected to a pickup drum 40, which cooperates with a blade 41 for cutting portions 3E transversely into portions 3E of desired length.

Portions 3E of desired length are transferred from pickup drum 40 to two transfer drums 42, and from the last transfer drum 42 to combining drum 35.

Combining drum 35 forms a portion group 4, in which two portions 3E of desired length are interposed coaxially between, and are positioned with respective ends axially contacting respective ends of the two portion groups 4 from wrapping unit $WU_1$ (as shown in FIGS. 4*f* and 5*f*). In other words, the two portions 3E are coaxial with portion groups 4 from wrapping unit $WU_1$, are interposed between the two portions 3D inserted on wrapping unit $WU_1$, and are positioned coaxial with, and with their respective ends facing, the two portions 3D.

Portion groups 4 are transferred from combining drum 35 to an application drum 43. And a sheet 44 of wrapping material, supplied by a feed unit 45, is applied to each portion group 4 in a seat on application drum 43. Each sheet 44 of wrapping material serves to mechanically connect the portion groups 4 from wrapping unit $WU_1$ and portions 3E of desired length (as shown in FIGS. 4*g* and 5*g*).

Wrapping unit $WU_2$ winds one sheet 44 of wrapping material about the whole circumference of each portion group 4. Sheet 44 of wrapping material surrounds the whole of each portion group 4, so as to mechanically connect the portion groups 4 from wrapping unit $WU_1$ and portions 3E of desired length.

As shown in FIGS. 1 and 2, feed unit 45 comprises an unwinding station 46 where a single-width strip is unwound off a reel (not shown); and a set of guide rollers for feeding the strip to a transverse cutting station 47, which comprises a roller that cooperates with a counter-roller, equipped with a number of peripheral blades, to cut the continuous strip transversely into individual sheets 44 of wrapping material, which are then fed to application drum 43 and wound about portion groups 4 on application drum 43.

Portion groups 4 with sheets 44 of wrapping material are transferred from application drum 43 to a rolling drum 48, on which winding of sheet 44 of wrapping material about each portion group 4 is completed to form a tubular wrapping coaxial with central axis X.

Wrapping unit $WU_2$ comprises a transfer drum, which receives portion groups 4 from rolling drum 48 and feeds them transversely to a cutting drum 50, which cooperates with a blade 51 to transversely cut each portion group 4 centrally, at portions 3E, into two cigarettes 2 coaxial with central axis X and contacting end to end (as shown schematically in FIGS. 4*h* and 5*h*).

The end of assembly machine 1 comprises a so-called 'tip-turning' drum 52, on which one line of cigarettes 2 is turned (as shown in FIGS. 4*i* and 5*i*) into the same orientation as the other line of cigarettes 2 alongside it, thus converting the two side by side lines of cigarettes 2 into one line of cigarettes 2 (obviously, with half the spacing of the two side by side lines of cigarettes 2).

Finally, the end of assembly machine 1 comprises a number of drums 53, on which samples are taken, cigarettes 2 are checked, and any faulty cigarettes 2 are rejected, up to an output conveyor 54, by which cigarettes 2 are transferred from assembly machine 1 t a packing machine (not shown).

The FIG. 2 variation of assembly machine 1 is the same as in FIG. 1 (and illustrated using the same reference numbers) except that wrapping unit $WU_1$ comprises no feed unit 17 for supplying end portions 3D. That is to say, cigarettes 2 only comprise portions 3A, 3B, 3C and 3E, which are fed to combining unit CU by feed unit 38 of wrapping unit $WU_2$.

In another variation, not shown, of assembly machine 1, wrapping unit $WU_2$ comprises no feed unit 38 for supplying central portions 3E. In other words, cigarettes 2 only comprise portions 3A, 3B, 3C and 3D, which are fed to combining unit CU by feed unit 17 of wrapping unit $WU_1$. In this case, too, wrapping unit $WU_2$ winds a single sheet 44 of wrapping material about the whole circumference of each portion group 4. Sheet 44 of wrapping material surrounds the whole of each portion group 4 to improve mechanical connection of the portion groups 4 from wrapping unit $WU_1$.

In another variation, not shown, of assembly machine 1, wrapping unit $WU_1$ comprises no feed unit 17 for supplying end portions 3D, and wrapping unit $WU_2$ comprises no feed unit 38 for supplying central portions 3E. In other words, cigarettes 2 only comprise portions 3A, 3B and 3C, which are fed to combining unit CU, and the portion group 4 from combining unit CU is wrapped in both sheets 26 and 44 of wrapping material on wrapping units $WU_1$ and $WU_2$ respectively. In this case, too, wrapping unit $WU_2$ winds a single sheet 44 of wrapping material about the whole circumference of each portion group 4 to improve mechanical connection of portion groups 4.

It is important to note that portion groups 4 are fed transversely (i.e. perpendicularly to their central axis X) along the whole of assembly machine 1. In other words, at no time are portion groups 4 fed longitudinally (i.e. parallel to their central axis X) along assembly machine 1.

Another important point to note is that assembly machine 1 described allows both the aromatic, preferably tobacco-based, portion 3 and the filter element portion 3 to be inserted selectively on any one of combining unit CU, wrapping unit $WU_1$, or wrapping unit $WU_2$ of assembly machine 1.

Assembly machine 1 described is cheap and easy to produce, by not being particularly complicated in design, and above all provides for effectively and efficiently producing cigarettes 2 or other tobacco articles comprising a number of different portions 3.

This is achieved by assembly machine 1 being adaptable to any combination of portions 3 by simply adapting feed stations 6 of combining unit CU, and feed units 17 and 38 of wrapping units $WU_1$ and $WU_2$.

The invention claimed is:

1. An assembly machine for producing multicomponent cigarettes, each comprising a number of portions, which have a central axis and comprise at least one portion defined by a filter element, and at least another portion defined by an aromatic, tobacco-based, element; the assembly machine comprising:

a combining unit for forming groups of portions, each comprising at least two different first portions aligned axially and contacting end to end, and in which the groups of portions travel perpendicularly to their central axis; the combining unit comprises a number of structurally identical feed stations, each for supplying a respective first portion of single length to form the groups of portions; and each feed station comprises an insertion drum which receives the groups of portions from a preceding feed station or creates the groups of portions, receives respective first portions, and inserts the respective first portions into the groups of portions;

a first wrapping unit, which receives a succession of groups of portions, aligned axially and contacting end to end, from the combining unit, feeds the groups of portions perpendicularly to their central axis, and winds a single first sheet of wrapping material around the whole circumference of each group of portions; and a second wrapping unit, which receives a succession of groups of portions from the first wrapping unit, feeds the groups of portions perpendicularly to their central axis, and winds a single second sheet of wrapping material around the whole circumference of each group of portions; wherein the second wrapping unit comprises a portion feed unit for inserting third portions into the groups of portions.

2. The assembly machine according to claim 1, wherein the first wrapping unit comprises a portion feed unit for inserting second portions into the groups of portions.

3. The assembly machine according to claim 2, wherein the first wrapping unit further comprises:

a first wrap feed unit for supplying first sheets of wrapping material; and the portion feed unit of the first wrapping unit is located upstream from the first wrap feed unit.

4. The assembly machine according to claim 1, wherein the second wrapping unit comprises:

a second wrap feed unit for supplying second sheets of wrapping material; and the portion feed unit of the second wrapping unit is located upstream from the second wrap feed unit.

5. The assembly machine according to claim 4, wherein each second sheet of wrapping material is wound around a corresponding group of portions to mechanically connect the third portion to the rest of the group of portions.

6. The assembly machine according to claim 1, wherein the second wrapping unit further comprises a cutting device, which cuts each group of portions transversely into two cigarettes.

7. The assembly machine according to claim 1, wherein each feed station comprises a hopper containing a mass of respective first portions; a cutting drum for cutting the first portions transversely to the desired length; and a pickup drum, which withdraws the first portions successively from the bottom of the hopper, cooperates with the cutting drum, and feeds the first portions of desired length to the insertion drum.

8. The assembly machine according to claim 1, further comprising a transfer unit interposed between the combining unit and the first wrapping unit, and having a drum, which receives the groups of portions from the combining unit and feeds them successively to the first wrapping unit.

9. The assembly machine according to claim 3, wherein the first wrap feed unit supplying the first sheets of wrapping material comprises:

an unwinding station for unwinding a continuous strip; and a transverse cutting station for cutting the continuous strip transversely into individual first sheets of wrapping material;

a first application drum, which receives the groups of portions and the individual first sheets of wrapping material, which are wound around the groups of portions; and a first rolling drum, which receives the groups of portions from the first application drum and completes winding the first sheets of wrapping material around the groups of portions to form a tubular wrapping coaxial with the central axis.

10. The assembly machine according to claim 9, wherein the first wrapping unit further comprises a cutting device, which receives the groups of portions from the first rolling drum and cuts each group of portions transversely.

11. The assembly machine according to claim 9, wherein the first wrapping unit comprises a first combining drum, which receives the groups of portions from the combining unit and the second portions of desired length from the portion feed unit of the first wrapping unit, inserts the second portions of desired length into the groups of portions, and feeds the groups of portions to the first application drum.

12. The assembly machine according to claim 3, wherein the portion feed unit of the first wrapping unit comprises a hopper containing a mass of second portions; a cutting drum for cutting the second portions transversely to the desired length; and a pickup drum, which withdraws the second portions successively from the hopper and cooperates with the cutting drum.

13. The assembly machine according to claim 4, wherein the second wrap feed unit supplying second sheets of wrapping material comprises:

an unwinding station for unwinding a continuous strip; and a transverse cutting station for cutting the continuous strip transversely into individual second sheets of wrapping material;

a second application drum, which receives the groups of portions and the second sheets of wrapping material, which are wound around the groups of portions; and a second rolling drum, which receives the groups of portions from the second application drum, and completes winding the second sheets of wrapping material around the groups of portions to form a tubular wrapping coaxial with the central axis.

14. The assembly machine according to claim 13, wherein the second wrapping unit comprises a second combining drum, which receives the groups of portions from the first wrapping unit and the third portions of desired length from the portion feed unit of the second wrapping unit, inserts the third portions of desired length into the groups of portions, and feeds the groups of portions to the second application drum.

15. The assembly machine according to claim 4, wherein the portion feed unit of the second wrapping unit comprises a hopper containing a mass of third portions; a cutting drum for cutting the third portions transversely to the desired length; and a pickup drum, which withdraws the third portions successively from the hopper and cooperates with the cutting drum.

16. A method of producing multicomponent cigarettes, each comprising a number of portions, which have a central axis and comprise at least one portion defined by a filter element, and at least another portion defined by an aromatic tobacco-based, element; the method comprising the steps of:

forming groups of portions, each comprising at least two different first portions aligned axially and contacting end to end;

feeding the groups of portions perpendicularly to their central axis;

winding a first sheet of wrapping material around the whole circumference of each group of portions;

inserting further portions into the groups of portions, once a tubular wrapping is formed from the first sheet of wrapping material around each group of portions; and winding a second sheet of wrapping material around the whole circumference of the group of portions.

17. The method according to claim 16, further comprising:

cutting each group of portions transversely into two cigarettes; and turning one line of cigarettes into the same orientation as the other line of cigarettes.

* * * * *